US012492542B2

(12) United States Patent
Roediger et al.

(10) Patent No.: US 12,492,542 B2
(45) Date of Patent: Dec. 9, 2025

(54) FUNCTIONAL UNIT FOR A SHOWER TOILET

(71) Applicant: Grohe AG, Hemer (DE)

(72) Inventors: Sascha Roediger, Schwerte (DE); Hendrik Heitkamp, Recklinghausen (DE)

(73) Assignee: GROHE AG, Hemer (DE)

( * ) Notice: Subject to any disclaimer, the term of this patent is extended or adjusted under 35 U.S.C. 154(b) by 76 days.

(21) Appl. No.: 18/425,182

(22) Filed: Jan. 29, 2024

(65) Prior Publication Data

US 2024/0254749 A1 Aug. 1, 2024

(30) Foreign Application Priority Data

Jan. 30, 2023 (DE) ..... 10 2023 102 159.1

(51) Int. Cl.
*E03D 9/08* (2006.01)
*E03B 7/07* (2006.01)

(52) U.S. Cl.
CPC ..... *E03D 9/08* (2013.01); *E03B 7/071* (2013.01); *E03B 7/075* (2013.01); *E03B 7/077* (2013.01); *E03B 7/078* (2013.01)

(58) Field of Classification Search
CPC . E03D 9/08; E03B 7/071; E03B 7/075; E03B 7/077; E03B 7/078
USPC ..... 4/300
See application file for complete search history.

(56) References Cited

U.S. PATENT DOCUMENTS

2005/0120471 A1 6/2005 Lim
2007/0234470 A1* 10/2007 Sawalski ..... E03D 9/032 4/223
2022/0162842 A1* 5/2022 Meier ..... E03D 1/30

FOREIGN PATENT DOCUMENTS

CN 114232742 A * 3/2022 ..... E03D 11/02
CN 118632961 A * 9/2024 ..... E03C 1/102
DE 20 2011 101 271 10/2012
DE 10 2013 207 053 10/2014
DE 20 2015 001 722 7/2016
DE 10 2015 110 294 1/2017
DE 102016009217 A1 * 2/2018 ..... E03D 9/005
EP 3299527 A1 * 3/2018 ..... E03D 9/08
EP 3995637 A1 * 5/2022 ..... E03D 9/08

* cited by examiner

*Primary Examiner* — Lori L Baker
(74) *Attorney, Agent, or Firm* — Wenderoth, Lind & Ponack, L.L.P.

(57) ABSTRACT

A functional unit (1) for a shower toilet (2), having at least the features listed below:
at least one shower device (3) for dispensing a liquid;
a liquid heater (5) for heating the liquid; and
a limescale filter (6) for filtering the liquid.
Additionally, a shower toilet (2) having such a functional unit (1).

5 Claims, 2 Drawing Sheets

FUNCTIONAL UNIT FOR A SHOWER TOILET

This application claims priority to German Patent Application No. 10 2023 102 159.1, filed Jan. 30, 2023, which is incorporated by reference herein in its entirety.

This invention relates to a functional unit for a shower toilet and a shower toilet having such a functional unit. In addition to absorbing bodily excretions, such shower toilets enable intimate hygiene by means of water jets.

Functional units are used, in particular, to accommodate functional components, such as a liquid inlet, a control valve, a liquid heater and/or a shower device for intimate hygiene. In particular, the functional components are disposed on a support plate or base plate, which can be used to attach the functional unit to a WC ceramic appliance or a toilet bowl. A toilet seat and/or a toilet lid can also be rotatably mounted to the functional unit. The liquid heater can be used to heat the liquid before the liquid is dispensed as a spray jet by the shower device.

If the liquid has a high water hardness, the functional unit or its functional components may be subject to heavy limescale build-up, particularly when using the liquid heater, which can result in functional impairment. To avoid this, a water purification system can be installed in a building's drinking-water system to reduce the water hardness of the liquid. However, installing the water purification system in an existing drinking water system involves a great deal of effort. In addition, the building's drinking-water supply must be interrupted during the installation of the water purification system.

Therefore, the invention addresses the problem of solving at least a part of the issues described with reference to the prior art and, in particular, of specifying a functional unit for a shower toilet, which can be used to prevent limescale build-up using little effort and without interrupting the drinking-water supply. In addition, a shower toilet having a functional unit, which prevents limescale build-up using little effort and without interrupting the drinking-water supply, is also to be specified.

These problems are solved by a functional unit and a shower toilet having the features of the independent claims. Further advantageous embodiments of the invention are specified in the dependent claims. It will be appreciated that the features listed individually in the dependent claims may be combined in any technologically useful manner and define further embodiments of the invention. In addition, the features indicated in the claims are further specified and explained in the description, wherein further preferred embodiments of the invention are illustrated.

A functional unit for a shower toilet, having at least the features listed below, contributes to solving the problem:

at least one shower device for dispensing a liquid;

a liquid heater for heating the liquid; and a limescale filter for filtering the liquid.

The functional unit is used, in particular, to create an intimate cleaning function in a shower toilet. The intimate cleaning function can be used to perform intimate cleaning using liquid jets after the shower toilet has been used. For this purpose, the functional unit can be attached to a WC ceramic appliance or a toilet bowl of the shower toilet, for instance by means of a screw connection, snap-in connection or clamp connection. The functional unit can comprise functional components such as a liquid inlet for connecting a liquid-supply line, a control valve for a liquid, a safety device to prevent return suction or backflow of the liquid (in particular to protect a drinking-water supply), an air gap for the liquid and/or a pump for the liquid.

The functional unit has at least one shower device for intimate cleaning as a functional component. The liquid, in particular water, can be dispensed by means of the at least one shower device. In particular, the liquid can be dispensed from the toilet bowl of the shower toilet in the direction of a user sitting on the shower toilet. For this purpose, the at least one shower device can have at least one dispensing nozzle for dispensing the liquid. In particular, the at least one dispensing nozzle can be mechanically, hydraulically and/or electrically movable or adjustable.

Another functional component of the functional unit is a liquid heater for heating the liquid. The liquid heater can be designed in the manner of an, in particular, electric, instantaneous water heater. The liquid heater can be used to heat the liquid to a temperature of up to 50° C., for instance. To supply the liquid heater with energy it can be connected to an electrical energy source.

Another functional component of the functional unit is a limescale filter for filtering the liquid. In particular, the limescale filter can at least reduce the limescale content of the liquid and/or the water hardness of the liquid. The limescale filter may be an ion-exchange filter, which removes the limescale by adsorption, or a mechanical filter, which filters out the limescale by filtration. The limescale filter may be exchangeable. For this purpose, the functional unit may have a holder or a seat for the limescale filter. The limescale filter may be inserted and/or screwed into the holder or seat, for instance without opening the housing of the functional unit. The limescale filter may be disposed downstream of the liquid inlet and/or the control valve (in a flow direction of the liquid through the functional unit or through a liquid duct of the functional unit). The limescale filter may be attached to a base plate of the functional unit. The limescale filter prevents the functional unit from building up limescale using little effort and without interrupting a building's drinking-water supply. In addition, there is no need to descale the functional unit using chemical agents.

The limescale filter may be disposed at least in part (or completely) in a housing of the functional unit. The housing of the functional unit may be at least partially made of plastic and/or metal. The housing may at least partially form an outer casing of the functional unit. The base plate may form part of the housing. The housing may have a cover, in particular, a removable cover. The cover may be attached to the base plate.

The limescale filter may be disposed upstream of the liquid heater. The limescale filter may be disposed in the direction of flow of the liquid through the functional unit or through the liquid duct of the functional unit upstream to the liquid heater. This can mean that when using the functional unit, the liquid may first flow through the limescale filter and only then through the liquid heater. The limescale filter may be disposed upstream of the pump and/or the at least one shower device. The limescale filter can prevent limescale build-up in the liquid heater, the pump and/or the at least one shower device.

The functional unit may have a pump for the liquid. The pump may, in particular, be an electrical pump. In particular, the pump can be used to control the dispensing of the liquid via the at least one shower device.

The functional unit may have a control valve for the liquid. The control valve may be electrically operated. The control valve may be a servo valve or solenoid valve, for instance. In particular, the control valve can be used to control the dispensing of the liquid via the at least one shower device.

The functional unit may have an air gap to prevent the liquid from flowing backwards. In particular, the liquid duct of the functional unit may have the air gap. The air gap may be a gap and/or an interruption in the liquid duct of the functional unit, through which the liquid can be prevented from flowing backwards, particularly in the direction of the liquid inlet. The air gap can prevent waste water from coming into contact with drinking water.

The limescale filter may be disposed upstream of the air gap. The limescale filter may be disposed upstream of the air gap in the direction of flow of the liquid through the functional unit or through the liquid duct of the functional unit. This can mean that when using the functional unit, the liquid may first flow through the limescale filter and only then through the air gap. The limescale filter can prevent limescale build-up in the air gap.

In accordance with another aspect, a shower toilet is also proposed, comprising at least the components listed below:

one toilet bowl; and one functional unit described here.

For further details on the shower toilet, reference is made in full to the description of the functional unit.

The invention and the technical environment are explained in more detail below with reference to the figures. It should be noted that the figures show a particularly preferred embodiment variant of the invention, but the invention is not limited thereto. The same reference numerals are used for the same components in the figures. In an exemplary and schematic manner:

Figure 1:
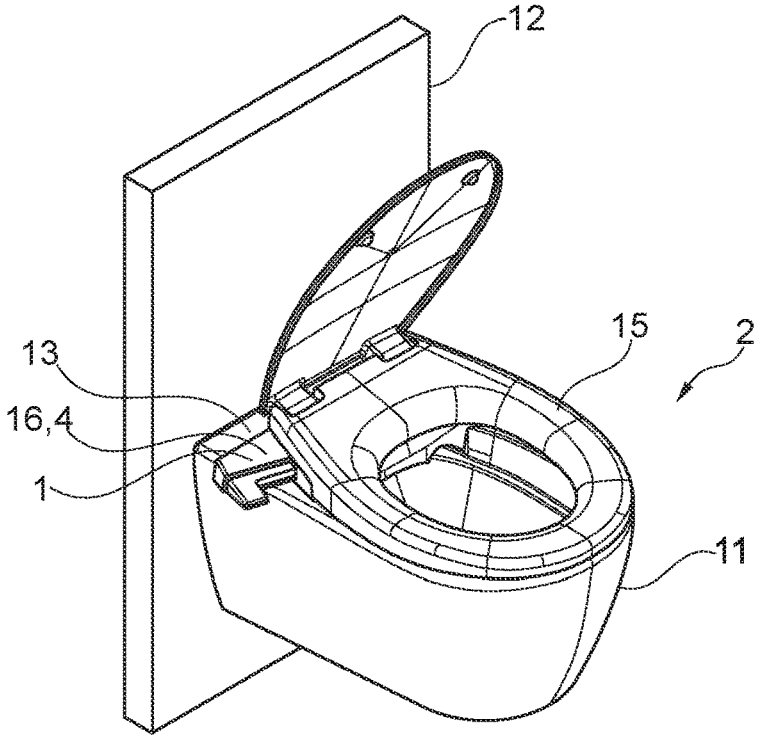
FIG. 1 shows a perspective representation of a shower toilet having a functional unit.

FIG. 1 shows a perspective representation of a shower toilet 2. The shower toilet 2 is mounted to a wall 12 and has a functional unit 1. The functional unit 1 is mounted to a top 13 of a toilet bowl 11 of the shower toilet 2. A toilet seat 15 is rotatably mounted or hinged on the functional unit 1.

Figure 2:
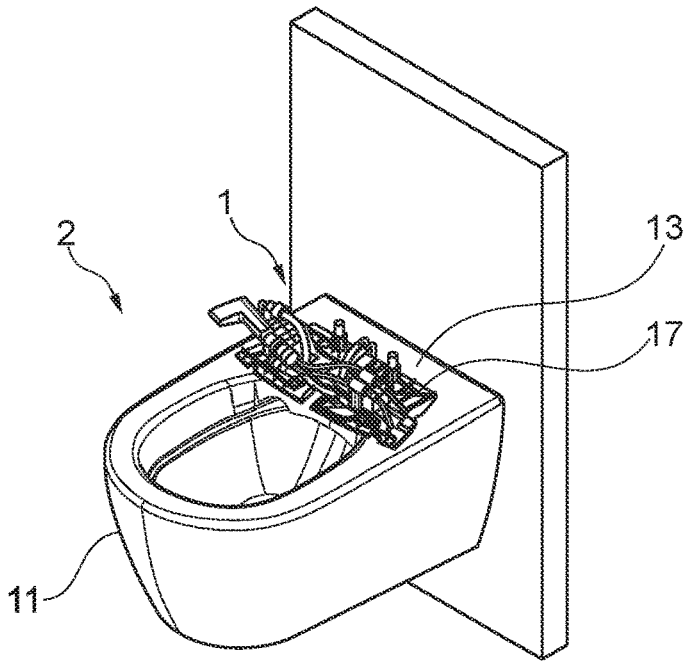
FIG. 2 shows the shower toilet with an open functional unit.

FIG. 2 shows the shower toilet 2 with an open functional unit 1. The shower toilet 2 is shown without the toilet seat 15 shown in FIG. 1 and without a cover 16 of a housing 7 of the functional unit 1. The functional unit 1 has a base plate 17, which is attached to the top 13 of the toilet bowl 11 and is used to hold functional components.

Figure 3:
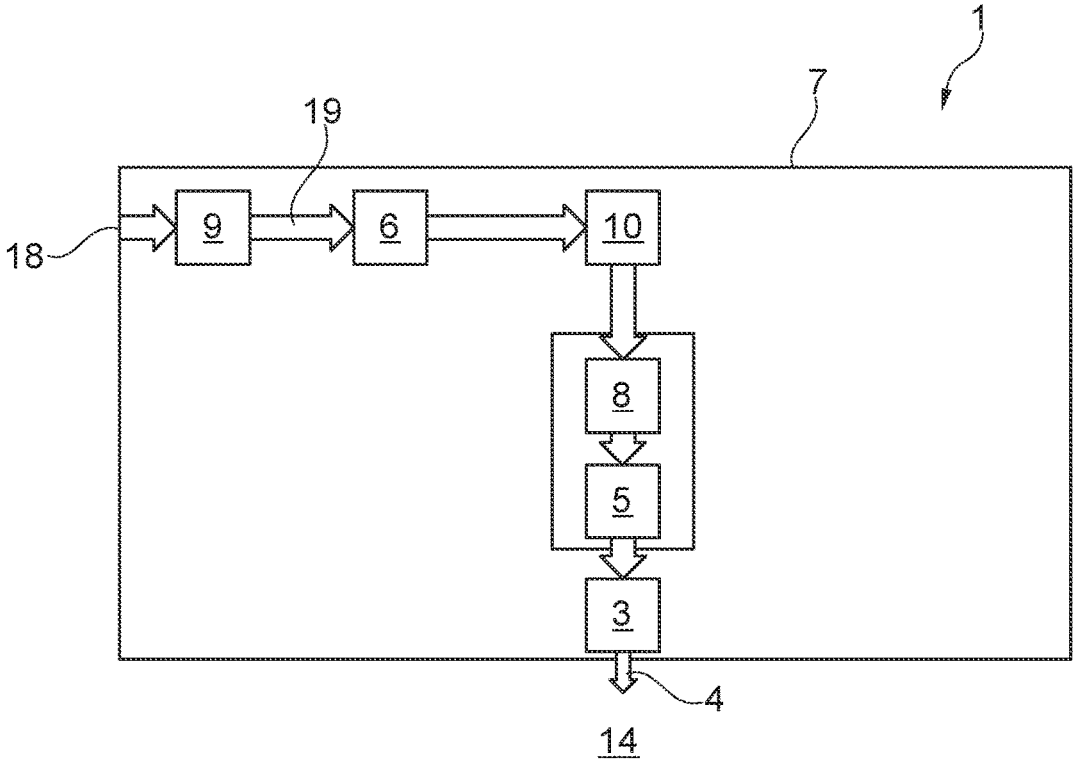
FIG. 3 shows a plan view of a schematic representation of the open functional unit.

FIG. 3 shows a plan view of a schematic representation of the open functional unit 1. The housing 7 has a liquid inlet 18, which can be used to supply liquid to the functional unit 1 from a liquid source not shown here. The functional unit 1 comprises a liquid duct 19 that extends from the liquid inlet 18 to a shower device 3. The liquid duct 19 is routed through a control valve 9, a limescale filter 6, an air gap 10, a pump 8 and a liquid heater 5. The limescale filter 6 is disposed along the liquid duct 19 downstream of the control valve 9 and upstream of the air gap 10, the pump 8, in the liquid heater 5 and the shower device 3. The liquid can be dispensed as a spray jet 4 through the shower device 3 to an environment 14 of the functional unit 1. The control valve 9 and/or the pump 8 can be used to control the delivery of liquid through the shower device 3. The limescale filter 6 can be used to reduce the limescale content of the liquid. The air gap 10 prevents the liquid from flowing backwards in the direction of the liquid inlet 18. The liquid heater 5 can be used to increase the temperature of the liquid.

This invention can be used to prevent limescale buildup using little effort and without interrupting a building's drinking-water supply.

LIST OF REFERENCE NUMERALS AND TERMS

1 functional unit
2 shower toilet
3 shower device
4 spray jet
5 liquid heater
6 limescale filter
7 body
8 pump
9 control valve
10 air gap
11 toilet bowl
12 wall
13 top face
14 environment
15 toilet seat
16 cover
17 base plate
18 liquid inlet
19 liquid duct

The invention claimed is:

1. A functional unit (1) for a shower toilet (2), comprising:
at least one shower device (3) for dispensing a liquid;
a liquid heater (5) for heating the liquid;
a limescale filter (6) for filtering the liquid disposed upstream of the liquid heater (5);
a pump (8) for the liquid; and
an air gap (10) that prevents the liquid from flowing backwards.

2. The functional unit (1) according to claim 1, wherein the limescale filter (6) is disposed at least in part in a housing (7) of the functional unit (1).

3. The functional unit (1) according to claim 1, further comprising a control valve (9) for the liquid.

4. The functional unit (1) according to claim 1, wherein the limescale filter (6) is disposed upstream of the air gap (10).

5. A shower toilet (2), comprising:
one toilet bowl (11); and
one functional unit (1) according to claim 1.

* * * * *